US006160760A

United States Patent [19]

Rayner

[11] Patent Number: 6,160,760

[45] Date of Patent: Dec. 12, 2000

[54] UNDERWATER SIGNALING DEVICE

[76] Inventor: Mark Rayner, 303, 220-26 Avenue S.W., Calgary, Canada, T2S 0M4

[21] Appl. No.: 09/329,447

[22] Filed: Jun. 11, 1999

[51] Int. Cl.[7] ..... G10K 1/07; B63C 11/26

[52] U.S. Cl. ..... 367/141; 367/910; 116/26; 116/137 R

[58] Field of Search ..... 367/134, 141, 367/910; 181/121, 113; 116/137 A, 137 R, 26, 27

[56] References Cited

U.S. PATENT DOCUMENTS

| | | | |
|---|---|---|---|
| 3,585,626 | 6/1971 | Tartarini | 340/279 |
| 3,738,446 | 6/1973 | Nottingham | 181/0.5 AG |
| 3,800,271 | 3/1974 | Stillman | 340/2 |
| 3,828,887 | 8/1974 | Alexander | 181/126 |
| 3,986,161 | 10/1976 | MacKellar | 340/6 R |
| 4,010,708 | 3/1977 | Keledy | 116/65 |
| 4,047,592 | 9/1977 | Sieber | 181/142 |
| 4,095,667 | 6/1978 | Mahig | 181/120 |
| 4,122,430 | 10/1978 | Leisterer | 340/5 R |
| 4,210,971 | 7/1980 | Martin | 367/134 |
| 4,335,452 | 6/1982 | Eberlin et al. | 367/134 |
| 4,633,969 | 1/1987 | Palmer | 181/118 |
| 4,635,242 | 1/1987 | Hart | 367/134 |
| 4,852,510 | 8/1989 | Josesh | 116/140 |
| 4,858,204 | 8/1989 | Holston et al. | 367/141 |
| 4,950,107 | 8/1990 | Hancock et al. | 116/26 |
| 4,975,890 | 12/1990 | Wolf | 367/131 |
| 5,010,529 | 4/1991 | Maynus | 367/137 |
| 5,022,790 | 6/1991 | Stevenson | 405/186 |
| 5,106,236 | 4/1992 | Hancock et al. | 405/186 |
| 5,168,471 | 12/1992 | Parra | 367/99 |
| 5,187,691 | 2/1993 | Oehme et al. | 367/134 |
| 5,200,932 | 4/1993 | Ljung | 367/174 |
| 5,251,187 | 10/1993 | Parra | 367/139 |
| 5,302,055 | 4/1994 | Johnston | 405/186 |
| 5,559,759 | 9/1996 | Gerstein | 367/139 |
| 5,652,734 | 7/1997 | Fish | 367/142 |

*Primary Examiner*—Ian J. Lobo
*Attorney, Agent, or Firm*—David S. Thompson

[57] ABSTRACT

An underwater signaling device 10 provides an enclosure 20 having handle 25 and barrel 21 portions. A trigger 40 is pivotally carried by the handle portion, and provides a pivoting spur 50 which extends into the barrel portion. A hammer 30 is sized for travel within the barrel portion. A primary spring 60, carried within a rearward end portion of the barrel is sized to propel the tip of the hammer into a bell 70 carried by a forward portion of the barrel. A primary spring 60, carried within a rearward end portion of the barrel is sized to propel the tip of the hammer into a bell 70 carried by a forward portion of the barrel. A secondary spring 65, carried within a forward end portion of the barrel is sized to urge the hammer out of contact with the bell after the initial impact, thereby preventing the hammer from damping the vibration of the bell. In operation, the trigger is manually activated, urging the hammer rearwardly, thereby compressing the primary spring. The trigger then releases the hammer, and the primary spring relaxes, causing the hammer to advance and the strike the bell. Movement of the hammer compresses the secondary spring, which then urges the hammer away from the bell and into a position between the relaxed primary and secondary springs. Release of the trigger causes the spur to pivot against the bias of its spring, allowing the spur to pass the end of the hammer. The spur then pivots to its resting position, engaged against the hammer.

11 Claims, 5 Drawing Sheets

UNDERWATER SIGNALING DEVICE

CROSS-REFERENCES

There are no applications related to this application filed in this or any foreign country.

BACKGROUND

A variety of underwater signaling devices are well-known. They address the need to communicate between divers using self contained underwater breathing apparatus, commonly known as "scuba."

Most known signaling devices include some type of electronic or mechanical device for causing vibration of a diaphragm, bell or horn. Despite the many known devices, existing devices have failed to solve all of the problems associated with underwater communication, and many of the devices have introduced additional problems.

Complexity, and associated financial costs, have prevented many devices from becoming widely used. Complex devices are based on both electronic and mechanical technologies. Complex devices also suffer from a correspondingly greater parts-counts and failure rates.

The need to modify equipment has also prevented some signaling devices from becoming popular. For example, signaling devices based on compressed air from the scuba tanks may require some type of Y-connector be added to an air hose. This type of modification is not popular, particularly since it could result in increased chances of the failure of the scuba device.

Other devices have buoyancy problems, and may result in adjustments being required to a diver's weight belt. Such devices may also be bulky and awkward to transport.

What is needed is a simple underwater signaling device that is usable from the surface or by a diver, for signaling an underwater diver. The device should be simple and mechanical, should have a dependable mechanism, and should be easily operated.

SUMMARY

The present invention is directed to an apparatus that satisfies the above needs. A novel underwater signaling device is disclosed that provides some or all of the following structures.

(A) An enclosure 20 is typically somewhat handgun-shaped, and defines a handle sized for convenient manual operation and a barrel which is typically oriented generally perpendicularly to the handle.

(B) A generally parabolic-shaped bell 70 is attached to an end portion of the barrel by fasteners which minimize damping of the vibration of the bell.

(C) A hammer 30 slides within the barrel of the enclosure and is sized to strike the bell causing it to ring.

(D) A trigger 40 is pivotally carried by a base portion of the handle, and is used to retract the hammer into a position from which the hammer jumps forwardly, striking the bell.

(E) A spur 50, pivotally carried by an upper portion of the trigger 40, is sized to engage the hammer, allowing the user to pull the hammer against the primary spring.

(F) A primary spring 60, carried within a rearward portion of the barrel, propels the hammer against the bell.

(G) A secondary spring 65, carried within a forward portion of the barrel, having a biasing force that is weaker than the primary spring, tends to urge the hammer away from the bell, thereby preventing the vibration of the bell from being damped.

A more detailed description of the underwater signaling device includes the following:

(A) The handle portion of the enclosure may additionally provide a water tight compartment 90, typically sealed by a cap having a built-in compass, and typically carrying survival supplies, such as matches, fish hooks and fishing line.

(B) The enclosure may additionally be made of fluorescent, glow-in-the-dark plastic material, thereby aiding use in dark underwater areas.

(C) A plurality of weights 80 may be interchangeably selected for insertion into the handle portion of the enclosure, thereby causing either slight positive or negative buoyancy for the entire device.

It is therefore a primary advantage of the present invention to provide a novel underwater signaling device having a parabola-shaped bell that produces a distinct audible tone when stuck by the hammer, thereby allowing a person on land, a dock, a boat or in the water to communicate with a diver in the water.

Another advantage of the present invention is to provide a novel underwater signaling device having an easily operated manual trigger operation, whereby the hammer may be forced to a rearward portion of the barrel of the enclosure against the bias of a primary spring and then released, whereby the primary spring drives the hammer against the bell.

Another advantage of the present invention is to provide a novel underwater signaling device having a secondary spring which urges the hammer to withdraw from the bell after contact, thereby preventing the hammer from damping the vibration of the bell.

A still further advantage of the present invention is to provide within a novel underwater signaling device a storage compartment for carrying survival supplies, and having an adjustable buoyancy system, whereby buoyancy may be adjusted to either positive or negative.

DRAWINGS

These and other features, aspects, and advantages of the present invention will become better understood with regard to the following description, appended claims, and accompanying drawings where:

DESCRIPTION

Figure 1:
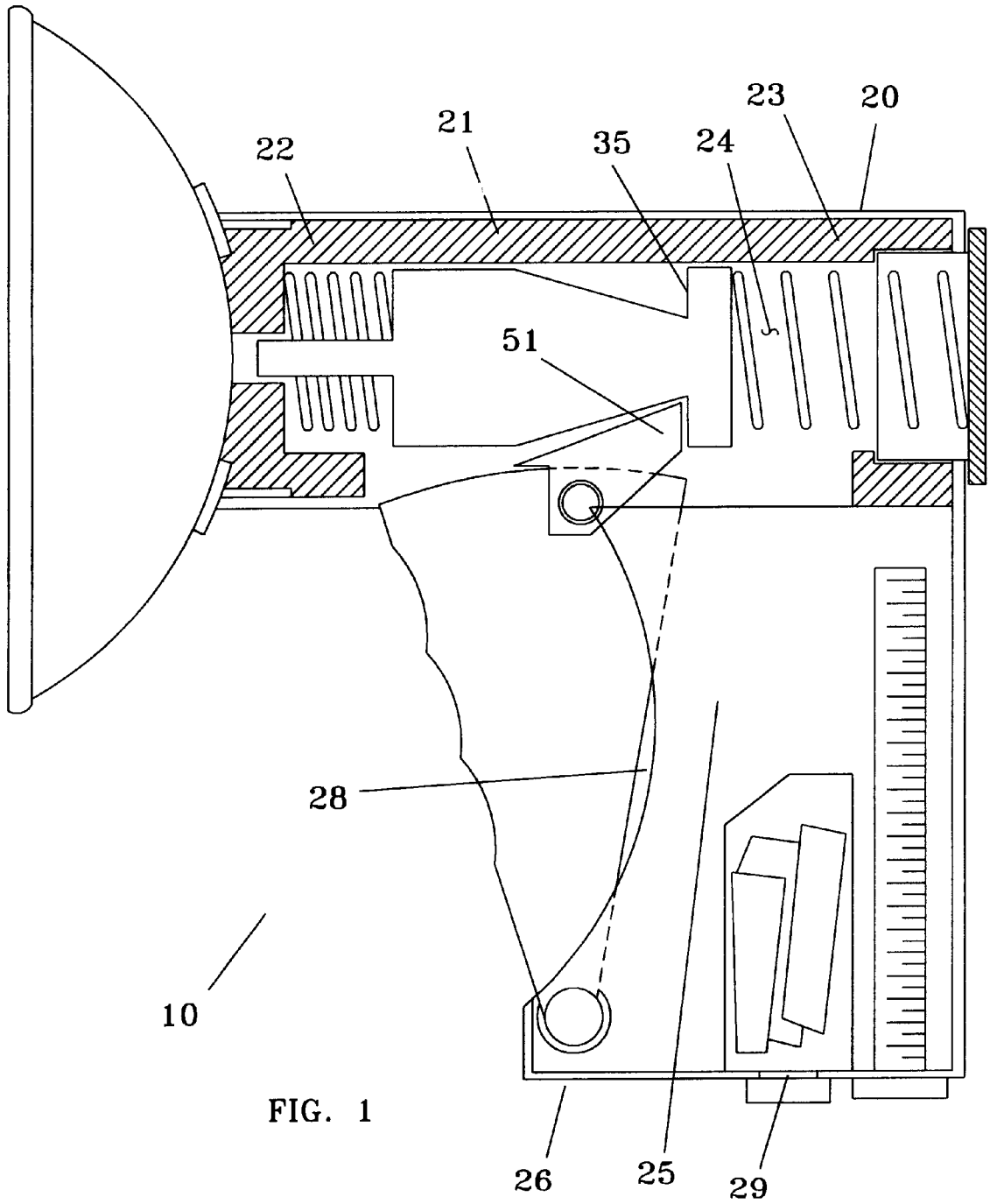
FIG. 1 is a side partial cross-sectional view showing a version of the underwater signaling device having the hammer and trigger in the resting position.

Referring in generally to FIGS. 1 through 5, an underwater signaling device 10 constructed in accordance with the principles of the invention is seen. The underwater signaling device provides an enclosure 20 having handle 25 and barrel 21 portions. A trigger 40 is pivotally carried by the handle portion, and provides a pivoting spur 50 which extends into the barrel portion. A hammer 30 is sized for travel within the barrel portion. A primary spring 60, carried within a rearward end portion of the barrel is sized to propel the tip of the hammer into a parabolic shaped bell 70 carried by a forward portion of the barrel. A secondary spring 65, carried within a forward end portion of the barrel is sized to urge the hammer out of contact with the bell after the initial impact, thereby preventing the hammer from damping the vibration of the bell. In operation, the trigger is manually activated, urging the hammer rearwardly, thereby compressing the primary spring. The trigger then releases the hammer, and the primary spring relaxes, causing the hammer to advance and the strike the bell. Movement of the hammer compresses the secondary spring, which then urges the hammer away from the bell and into a position between the relaxed primary and secondary springs. Release of the trigger causes the spur to pivot against the bias of its spring, allowing the spur to pass the end of the hammer. The spur then pivots to its resting position, engaged against the hammer.

Referring particularly to FIG. 1, the enclosure 20 is seen in cross-section. A preferred enclosure is somewhat handgun-shaped and provides connected barrel 21 and handle 25 portions, typically oriented at approximately right angles. A hollow cavity 24 is defined within the barrel 21, and is sized for lengthwise travel of the hammer 30 between a forward end portion 22 and a rearward end portion 23 of the barrel.

Upper and lower trigger openings 27, 28 are defined in the handle, and allow the trigger 40 to move in the manner depicted by the figures. A base portion 26 of the handle 25 defines an opening 29 to a storage compartment 90.

The enclosure is typically made of plastic. A preferred version of the enclosure is made of fluorescent green, fluorescent yellow, white or marine blue, and may be made of glow-in-the-dark material.

As seen in the figures, a trigger 40 is manually pivotable about a pivot 41 carried by a portion of the handle 25 adjacent to the base 26. The range of motion of the trigger can be understood by a comparison of the figures. The trigger is seen in a forward position in FIG. 1, an intermediate position in FIG. 5, and a rearward position in FIG. 3. In a preferred embodiment of the invention, the range of motion is primarily limited by the geometry of the enclosure and the upper and lower trigger openings 27, 28.

Figure 2:
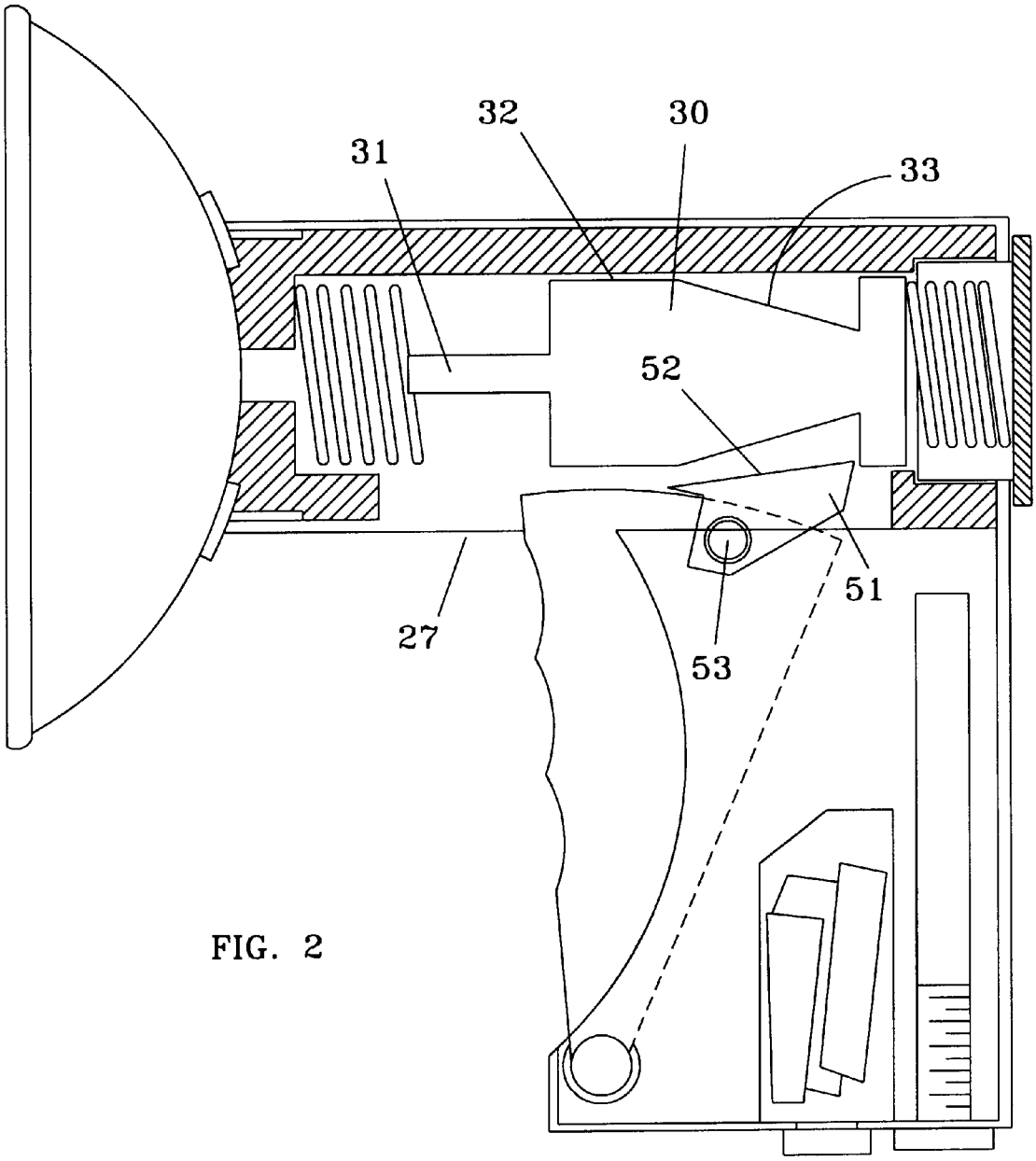
FIG. 2 is a view similar to that of FIG. 1, wherein the trigger and hammer have been almost fully retracted and the primary spring fully compressed. Very slight additional retraction of the hammer will result in release of the hammer which will then be pushed forward by the primary spring.
Figure 3:
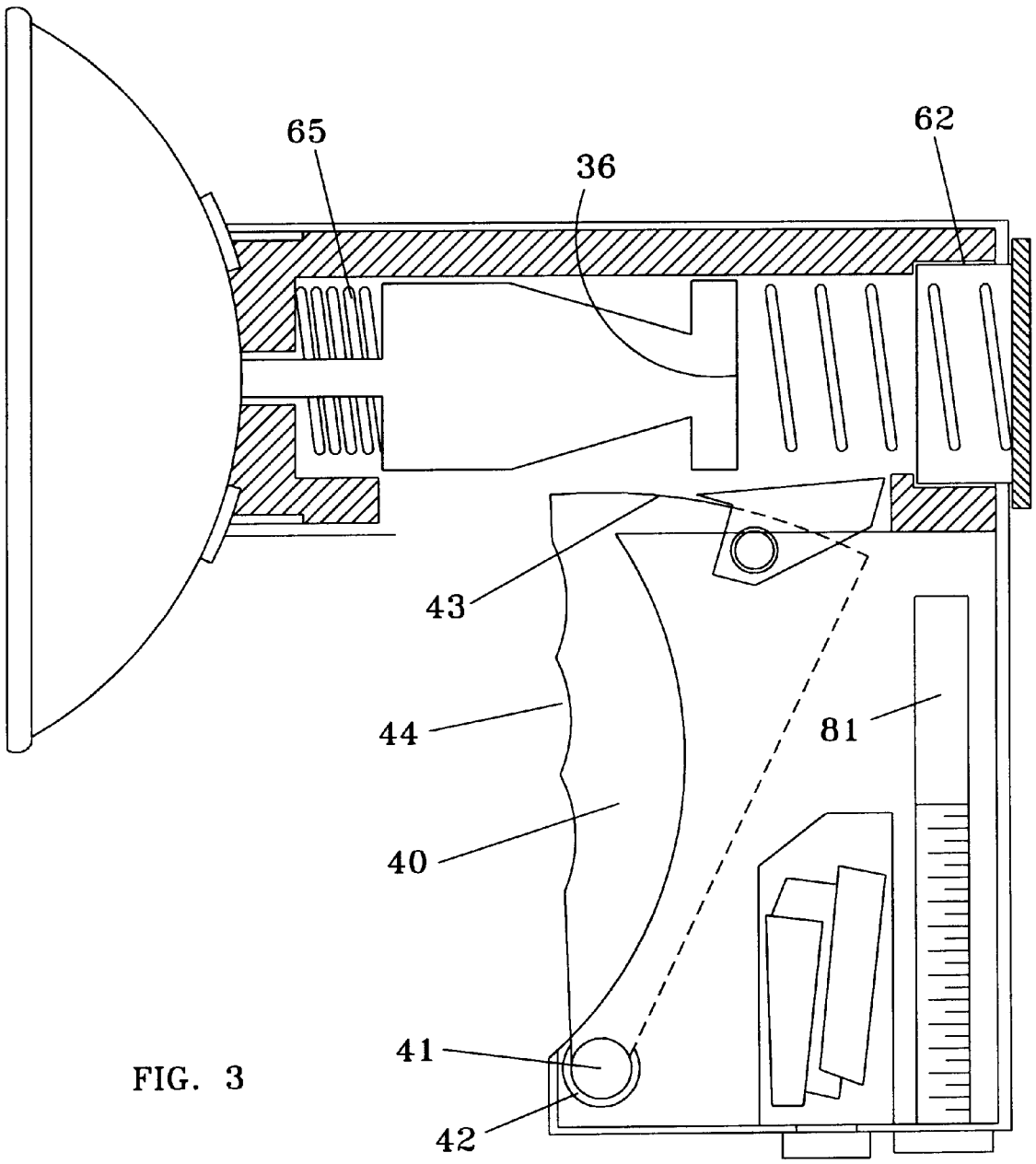
FIG. 3 is a view similar to that of FIG. 2, wherein the hammer has been thrust fully forward by the primary spring. The tip of the hammer has stuck the bell and the secondary spring is fully compressed.

The length of the trigger 40 is sufficient that the spur 50 carried by the upper edge 43 makes contact with the shoulder 35 of the hammer 30 when the trigger is in the at-rest position of FIG. 1 and prior to release of the hammer, as seen in FIG. 2. When the trigger is fully in the rearward position, as seen in FIG. 3, the length of the trigger is insufficient to continue contact with the shoulder, and the hammer moves forward, past the spur carried by the trigger.

The trigger is biased against the enclosure by a coil spring 42, which wraps about the pivot 41, into the forward position, as seen in FIG. 1. A grip 44 surface allows the user to comfortably grip the trigger during operation. The trigger may be made of rugged pvc plastic or other suitable material.

The spur 50 is carried on the upper edge 43 of the trigger. When the trigger is moving the hammer against the resistance of the primary spring, the spur engages the hammer with a foot 51, thereby transmitting force from the trigger to the hammer. The foot of the spur travels in a generally circular path, resulting in the release of the hammer.

Figure 5:
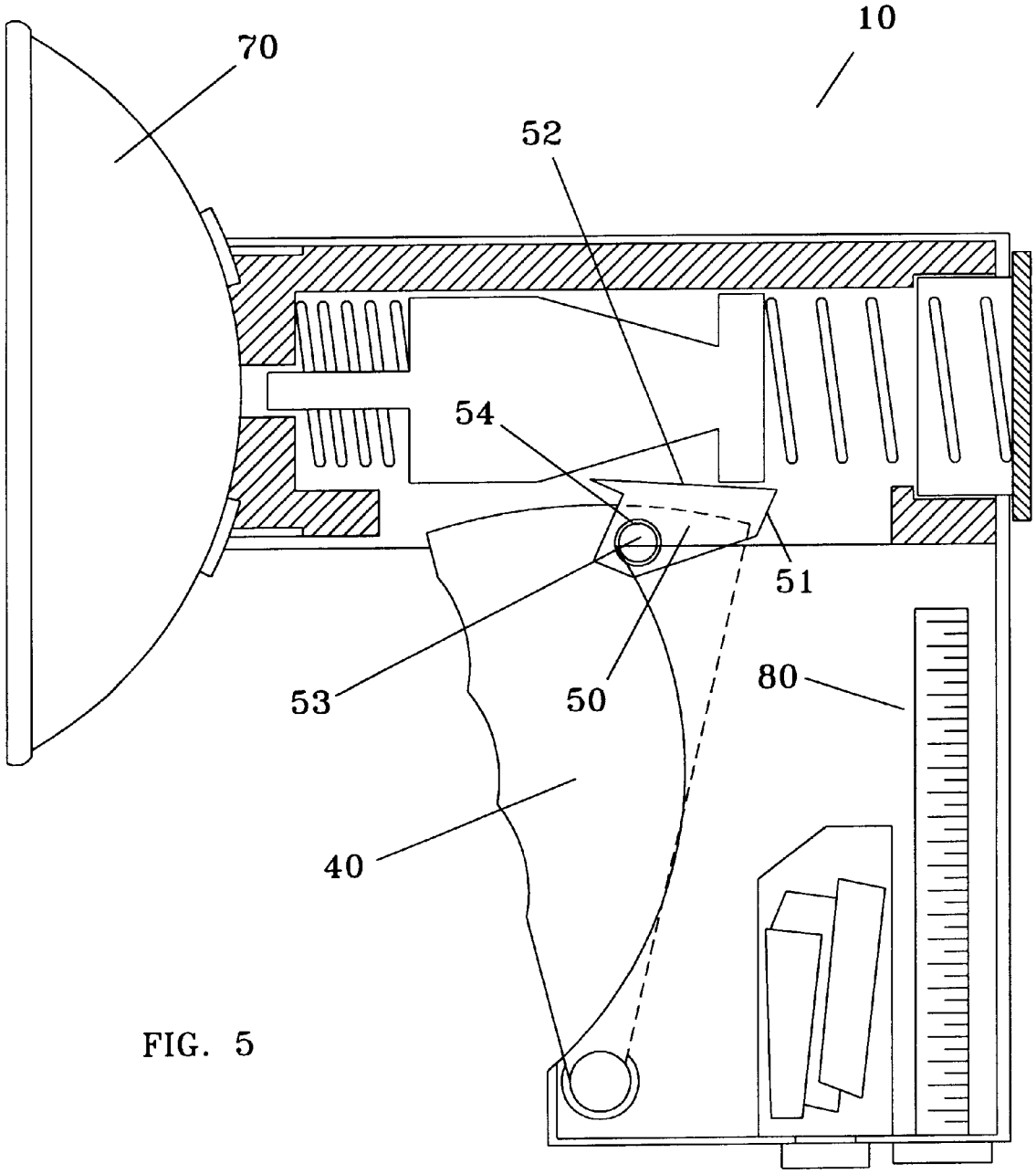
FIG. 5 is a view similar to that of FIG. 4, wherein the hammer, the primary and the secondary springs are at rest, and the trigger is being released, thereby allowing it to return to its original position. The spur portion of the trigger is rotated slightly about its pivot, against the bias of its spring, allowing the spur to move past the cylindrical end of the hammer.

After the hammer is released and moves to the forward end 22 of the barrel, the operator releases the trigger, which begins to pivot under the urging of spring 42 to the position seen in FIG. 1. Movement of the trigger causes the slide surface 52 of the spur to contact the hammer. Contact between the slide surface and the hammer causes the spur to rotate about pivot 53, as seen in FIG. 5, so that the spur may move past the hammer. As the spur pivots, the spring 54 is stressed. Continued movement of the trigger allows the slide surface 52 to move against the cylindrical end 34 of the hammer until the trigger is fully released by the operator. When the trigger is fully released, the slide surface of the spur moves past the hammer, and the spur pivots back to the position seen in FIG. 1, under the urging of spring 54. Rotation of the spur results in the foot 51 of the spur engaging the hammer, as seen in FIG. 1.

As seen in the figures, the hammer 30 travels in an axial manner in the hollow barrel cavity 24. The generally cylindrical body 32 of the hammer is incrementally smaller than the hollow barrel cavity 24, allowing the hammer to slide easily. A forward portion of the hammer carries a tip 31 of a diameter that is generally less than that of the cylindrical body 32.

A tapered conical portion 33, extending rearwardly of the cylindrical body, results in a cavity within which the spur 50 may rest. A cylindrical end 34 having a shoulder 35 allows the spur to engage the hammer and push the hammer toward the rear end portion 23 of the barrel 21 as seen in FIG. 2.

The hammer is typically made of stainless steel or aluminum.

As seen particularly in FIG. 1, the primary spring 60 is a compression spring, which is normally relaxed in its elongated state. The diameter of the primary spring is somewhat less than the end 36 of the hammer. The rear portion of the primary spring is carried within a spring cap 61, typically having a threaded surface 62 which may be screwed onto the rear portion of the barrel, as seen in the figures.

The primary spring must have sufficient capability to store energy so that when it is fully compressed, as seen in FIG. 2, it is capable of forcing the hammer against the bell, as seen in FIG. 3. This movement of the hammer requires the compression of the secondary spring 65, as will be further discussed.

As seen particularly in FIG. 1, the secondary spring 65 is a compression spring, which is normally relaxed in its elongated state. The secondary spring pushes the hammer away from the bell after the hammer has rung the bell. This prevents the hammer from damping the vibration of the bell, and thereby muting the bell.

The diameter of the secondary spring is somewhat less than the cylindrical body 32 of the hammer 30, but greater than the diameter of the tip 31. The forward portion of the secondary spring is attached to the bell or enclosure, as seen.

The secondary spring must be sufficiently weak, i.e. must compress sufficiently easily, so that the hammer, when propelled by the primary spring, compresses the secondary spring, allowing the tip of the hammer to strike the bell 70.

As seen in FIG. 1, the parabolic shaped bell 70 is attached to a forward portion of the barrel 21 of the enclosure 20 by a fastener 72 and associated pad 73. The fastener allows the bell to be secured to the enclosure, but also allows the bell to vibrate with as much freedom as possible. The pads 73, which can be made of foam or similar material, tend to flex somewhat, thereby allowing the bell to vibrate with a minimum of damping by the enclosure.

A preferred version of the bell provides a rolled edge 71, which eliminates the chance of injury which may otherwise result from a sharp edge.

A weight 80 is carried in a channel 81 defined in the enclosure and allows control over the buoyancy of the underwater signaling device. In one embodiment of the invention, the weight 80 is a bolt, selected from a collection of bolts having the same diameter and different lengths. The selected bolt is threaded into the channel 81, thereby allowing the weight of the underwater signaling device to be regulated.

As seen in FIG. 1, where the weight 80 is relatively large, negative buoyancy results. Where the weight is small, as illustrated in FIG. 2, positive buoyancy results. Where the weight is of intermediate size as seen in FIG. 3, neutral buoyancy results.

Where desired, lead or steel shot can be substituted for the weights illustrated.

In a preferred version of the invention, a storage compartment 90 is defined by interior walls 92 within the enclosure 20. A preferred threaded cap 91 has a built-in compass. The storage compartment 90 is typically used to carry matches 93, fish hooks 94 and fishing line 95, or similar survival supplies.

In operation, the movement of the various parts result in the sequence of cross-sectional views seen in FIGS. 1–5.

As seen in FIG. 1, the primary and secondary springs are both in the relaxed position, and the hammer is carried between them. The coil spring 42 of the trigger 40 is also in the relaxed position, and the trigger is in its at-rest position. Similarly, the coil spring 54 of the spur 50 is in the relaxed position, and the spur is in its at-rest position. The primary and secondary springs are selected so that the springs, in their relaxed states, extend to, and touch, the cylindrical end 34 and cylindrical body 32 of the hammer, respectively. This keeps the hammer from moving unless the trigger is moved.

As seen in FIG. 2, the trigger has been manually pulled most of the way back, thereby partially compressing the primary spring, and putting some tension on the coil spring of the trigger. The spur 50 carried by the trigger is in contact with the shoulder of the hammer, pushing the hammer rearwardly. The hand of the person applying force to the trigger is not shown.

It should be understood that the foot 51 of the spur 50 moves in a circular path. As a result, when the trigger is pulled back from the position seen in FIG. 1, it contacts the shoulder 35 of the hammer. Contact between the spur and hammer continues, as seen in FIG. 2, until the hammer is almost all the way to the rear 23 of the barrel 21, as is the case in the view of FIG. 2.

However, as seen in FIG. 3, when the trigger is pulled fully backward, the foot 51 of the spur 50 is almost ready to release the hammer, due to the curving path of its movement. As a result, the hammer has shot forward, as the primary spring elongates into its relaxed position. Contact between the hammer and bell causes vibration and sound.

As seen in FIG. 3, the movement of the hammer forward has fully compressed the secondary spring. In the view of FIG. 3 the coil spring of the trigger is still tensioned; the hand holding the trigger backward is not shown.

Figure 4:
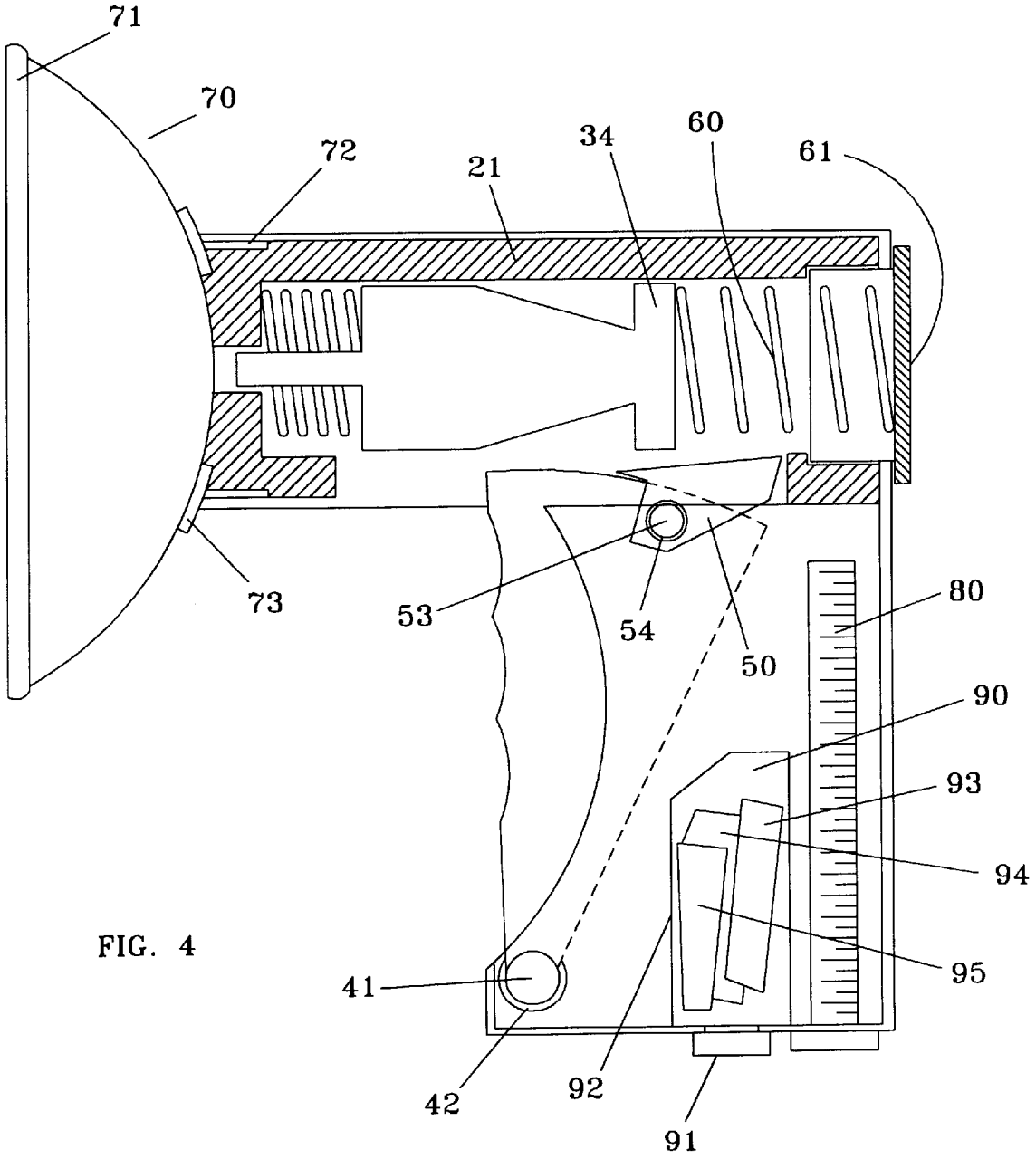
FIG. 4 is a view similar to that of FIG. 3, wherein the tip of the hammer has been pushed, by the secondary spring, slightly away from the bell to prevent damping of the vibration of the bell.

As seen in FIG. 4, the secondary spring has elongated into the relaxed position, pushing the hammer to its at-rest position, between the relaxed primary and relaxed secondary springs. This prevents the hammer from damping the vibration of the bell. The foot of the spur is still behind the cylindrical end of the hammer, however, and the trigger therefore continues to be manually held by the user.

Referring to FIG. 5, the user has reduced pressure on the trigger, and the coil spring 42 of the trigger 40 has forced the trigger somewhat forward. The cylindrical end of the hammer has contacted the slide surface 52 of the spur, causing the spur to rotate about the pivot 53, thereby tensioning the spring 54. As the trigger moves forward, relaxing the spring 42, the slide surface 52 of the spur will slip off the cylindrical end 34 of the hammer, due to the circular pathway of the spur. The spur will then pivot, due to relaxation of the coil spring 54, causing the foot 51 of the spur to once again engage the shoulder 35 of the hammer, as seen in FIG. 1.

The previously described versions of the present invention have many advantages, including a primary advantage of the present invention to providing a novel underwater signaling device having a parabola-shaped bell that produces a distinct audible tone when stuck by the hammer, thereby allowing a person on land, a dock, a boat or in the water to communicate with a diver in the water.

Another advantage of the present invention is to provide a novel underwater signaling device having an easily operated manual trigger operation, whereby the hammer may be forced to a rearward portion of the barrel of the enclosure against the bias of a primary spring and then released, whereby the primary spring drives the hammer against the bell.

Another advantage of the present invention is to provide a novel underwater signaling device having a secondary spring which urges the hammer to withdraw from the bell after contact, thereby preventing the hammer from damping the vibration of the bell.

A still further advantage of the present invention is to provide within a novel underwater signaling device a storage compartment for carrying survival supplies, and having an adjustable buoyancy system, whereby buoyancy may be adjusted to either positive or negative.

Although the present invention has been described in considerable detail and with reference to certain preferred versions, other versions are possible. For example, while the preferred enclosure is somewhat gun-shaped, this is not required. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An underwater signaling device, comprising:

(A) an enclosure;

(B) a bell attached to the enclosure;

(C) a hammer, carried within the enclosure;

(D) primary spring means, carried within the enclosure and in contact with the hammer, for propelling the hammer against the bell, thereby causing the bell to vibrate audibly;

(E) trigger means, pivotally carried by the enclosure, for moving the hammer against the resistance of the primary spring means;

(F) secondary spring means, carried within the enclosure and in contact with the hammer, for urging the hammer away from the bell, thereby preventing the vibration of the bell from being damped; and (G) spur means, pivotally carried by an upper edge of the trigger, for engaging the hammer with a foot when the trigger moves the hammer against the resistance of the primary spring means, and for pivoting to move past the hammer after the hammer has been propelled against the bell.

2. The underwater signaling device of claim 1, additionally comprising:

(A) pad means, carried between the bell and the enclosure, for reducing the degree to which the enclosure damps the vibration of the bell.

3. The underwater signaling device of claim 1, additionally comprising biasing means for biasing the trigger against the enclosure.

4. The underwater signaling device of claim 1, additionally comprising a water tight storage compartment, defined within the enclosure.

5. The underwater signaling device of claim 4, additionally comprising a cap, having a built-in compass, for sealing the water tight storage compartment.

6. The underwater signaling device of claim 1, wherein the enclosure is made of fluorescent material, thereby aiding use in dark underwater areas.

7. An underwater signaling device, comprising:

(A) an enclosure;

(B) a bell attached to the enclosure;

(C) a hammer, carried within the enclosure;

(D) primary spring means, carried within the enclosure and in contact with the hammer, for propelling the hammer against the bell, thereby causing the bell to vibrate audibly;

(E) trigger means, pivotally carried by the enclosure, for moving the hammer against the resistance of the primary spring means;

(F) spur means, pivotally carried by an upper edge of the trigger, for engaging the hammer with a foot when the trigger moves the hammer against the resistance of the primary spring means, and for pivoting to move past the hammer after the hammer has been propelled against the bell.

(G) secondary spring means, carried within the enclosure and in contact with the hammer, for urging the hammer away from the bell, thereby preventing the vibration of the bell from being damped; and (H) weight means, carried in a channel defined in the enclosure, for controlling the buoyancy of the underwater signal device.

8. The underwater signaling device of claim 7, additionally comprising biasing means for biasing the trigger against the enclosure.

9. The underwater signaling device of claim 7, additionally comprising a water tight storage compartment, defined within the enclosure.

10. The underwater signaling device of claim 9, additionally comprising a cap, having a built-in compass, for sealing the water tight storage compartment.

11. The underwater signaling device of claim 7, wherein the enclosure is made of fluorescent material, thereby aiding use in dark underwater areas.

* * * * *